US008934814B2

(12) United States Patent
Wu

(10) Patent No.: US 8,934,814 B2
(45) Date of Patent: Jan. 13, 2015

(54) MULTIFUNCTION PRINTER

(71) Applicant: Kinpo Electronics, Inc., New Taipei (TW)

(72) Inventor: Yen-Jui Wu, New Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 101 days.

(21) Appl. No.: 13/769,827

(22) Filed: Feb. 19, 2013

(65) Prior Publication Data

US 2014/0132137 A1 May 15, 2014

(30) Foreign Application Priority Data

Nov. 15, 2012 (TW) ..... 101142678 A

(51) Int. Cl.
*B41J 29/13* (2006.01)
*B41J 29/02* (2006.01)

(52) U.S. Cl.
CPC . *B41J 29/13* (2013.01); *B41J 29/02* (2013.01)
USPC ..... 399/125; 347/108

(58) Field of Classification Search
CPC ..... G03G 21/16; G03G 21/1633; G03G 21/1647; B41J 29/13
USPC ..... 312/326; 358/474; 399/107, 110, 125, 399/380; 347/108
See application file for complete search history.

(56) References Cited

U.S. PATENT DOCUMENTS

| | | | | |
|---|---|---|---|---|
| 4,814,817 | A * | 3/1989 | Nishijima et al. | 399/125 |
| 5,162,846 | A * | 11/1992 | Cahill | 399/125 |
| 6,032,004 | A * | 2/2000 | Mirabella et al. | 399/90 |
| 6,081,630 | A | 6/2000 | Kaneko | |
| 6,510,301 | B2 * | 1/2003 | Tanaka | 399/125 |
| 7,299,525 | B2 | 11/2007 | Chang | |
| 7,561,825 | B2 * | 7/2009 | Hirose et al. | 399/110 |
| 7,804,628 | B2 * | 9/2010 | Hashimoto et al. | 358/494 |
| 8,237,995 | B2 | 8/2012 | Yamazaki et al. | |
| 2003/0206224 | A1 * | 11/2003 | Sakakibara et al. | 347/108 |
| 2006/0067760 | A1 * | 3/2006 | Shimizu et al. | 399/377 |
| 2006/0222435 | A1 * | 10/2006 | Ha et al. | 400/691 |
| 2008/0062448 | A1 * | 3/2008 | Saito | 358/1.13 |
| 2011/0075230 | A1 | 3/2011 | Kawai | |

FOREIGN PATENT DOCUMENTS

TW I232673 5/2005

* cited by examiner

*Primary Examiner* — James O Hansen
(74) *Attorney, Agent, or Firm* — Jianq Chyun IP Office

(57) ABSTRACT

A multifunction printer including a machine body, a first cover, a second cover, a third cover and a fixing element is provided. The first cover and the second cover are hinged, and the second cover and the third cover are hinged and the third cover is hinged on the machine body, wherein the second cover is installed between the first cover and the third cover. The fixing element is installed in the second cover to lock the third cover or unlock the third cover. When the first cover is opened relative to the second cover, the third cover is locked each other by the fixing element. When the first cover is closed relative to the second cover, the third cover is unlocked by the fixing element.

18 Claims, 15 Drawing Sheets

MULTIFUNCTION PRINTER

CROSS-REFERENCE TO RELATED APPLICATION

This application claims the priority benefit of Taiwan application serial no. 101142678, filed on Nov. 15, 2012. The entirety of the above-mentioned patent application is hereby incorporated by reference herein and made a part of this specification.

BACKGROUND

1. Field of the Invention

The present invention is directed to a multifunction printer and more particularly, to a multifunction printer having a fixing element capable of locking or unlocking covers.

2. Description of Related Art

Generally, a scanner, a photocopying machine or a multifunction printer has an upper cover that is capable of being opened or closed relative to its machine body. Taking the multifunction printer for example, due to having a large volume, the multifunction printer is commonly placed at a corner in the office for staffs to print or scan documents.

A scanner of the multifunction printer is installed on the machine body of the multifunction printer. The scanner includes a scan lid and a scan base, and a mid chassis is also installed on the machine body to fix the scan base. When the scan base is opened relative to the machine body, elements inside the machine body are exposed for a maintenance person or a user to conveniently repair or replace the elements (e.g. an ink cartridge) inside the machine body of the multifunction printer.

Typically, when desiring to use the scanning function of the scanner, the user only needs to open the scan lid relative to the scan base, and when desiring to repair or replace an element in the machine body, the user needs to open both the scan lid and the scan base. However, without disposing an element capable of locking the scan lid, the scan base or the mid chassis, it is possible for the user to open the scan base as well even though the user only wants to open the scan lid.

Among the current multifunction printers, it is commonly to install two fixing elements used for pairwise locking any two of the scan lid, the scan base and the mid chassis, wherein one of the fixing elements is used for locking the scan lid and the scan base, while the other is used for locking the scan base and the mid chassis.

SUMMARY

The present invention is directed to a multifunction printer having magnetic elements and a fixing element, and the fixing element may be pivotally rotated by magnetism between the magnetic elements so that covers may be locked or unlocked.

The present invention is directed to a multifunction printer including a fixing element having a boss, and the fixing element may be pivotally rotated by the boss so that covers may be locked or unlocked.

The present invention is directed to a multifunction printer having a fixing element capable of locking or unlocking covers.

The present invention is directed to a multifunction printer including a machine body, a first cover, a second cover, a third cover, a fixing element, a first magnetic element and a second magnetic element. The first cover and the second cover are hinged, the second cover and third cover are hinged, and the third cover is hinged on the machine body. The second cover is installed between the first cover and the third cover. The fixing element is installed in the second cover and capable of being pivotally rotated in the second cover. The first magnetic element is installed on the first cover, and the second magnetic element is installed on the fixing element. When the second cover is closed relative to the third cover and the first cover is opened relative to the second cover to make the first magnetic element and the second magnetic element depart from each other, the third cover is locked by the fixing element. When the first cover is closed relative to the second cover to make the first magnetic element and the second magnetic element approach to each other, the third cover is unlocked by the fixing element.

In an embodiment of the present invention, the second cover includes an upper case and a lower case. The lower case is hinged to the third cover and has an opening. The fixing element is pivoted to the lower case and has a locking portion. When the second cover is closed relative to the third cover, the lower case is located between the upper case and the third cover and the opening faces a wall portion of the third cover. When the fixing element is pivotally rotated relative to the lower case, locking portion the locking portion passes through the opening to lock or unlock the wall portion of the third cover.

In an embodiment of the present invention, the first magnetic element and the second magnetic element are magnetically repelled to each other. When the third cover is locked by the fixing element and the first cover is closed relative to the second cover, the first magnetic element approaches the second magnetic element and the fixing element is driven to pivotally rotate by the magnetic repulsion force between the first magnetic element and the second magnetic element so as to enable the fixing element to unlock the third cover. When the second cover is closed relative to the third cover and the first cover is opened relative to the second cover, the first magnetic element departs from the second magnetic element, and the fixing element is pivotally rotated due to the gravity so as to enable the fixing element to lock the third cover.

In an embodiment of the present invention, the first magnetic element and the second magnetic element are magnetically attracted to each other. When the second cover and the third cover are locked with each other by the fixing element and the first cover is closed relative to the second cover, the first magnetic element approaches the second magnetic element and the fixing element is driven to pivotally rotate by the magnetic attraction force between the first magnetic element and the second magnetic element so as to enable the fixing element to unlock the third cover. When the second cover is closed relative to the third cover and the first cover is opened relative to the second cover, the first magnetic element departs from the second magnetic element and the fixing element is pivotally rotated due to the gravity so as to enable the fixing element to lock the third cover.

In an embodiment of the present invention, the first cover is a scan lid.

In an embodiment of the present invention, the second cover is a scan base.

In an embodiment of the present invention, the third cover is a mid chassis.

The present invention is further directed to a multifunction printer including a machine body, a first cover, a second cover, a third cover and a fixing element. The first cover and the second cover are hinged, the second cover and the third cover are hinged, and the third cover is hinged on the machine body. The second cover is installed between the first cover and the third cover. The fixing element is pivoted to the second cover. The fixing element has a boss protruding from the second cover and facing the first cover. When the second cover is closed relative to the third cover and the first cover is opened relative to the second cover to make the first cover depart from the boss, the third cover is locked by the fixing element. When the first cover is closed relative to the second cover, the boss is pressed by the first cover to drive the fixing element to pivotally rotate to enable the fixing element to unlock the third cover.

In an embodiment of the present invention, the second cover includes an upper case and a lower case. The upper case has a through hole. The boss passes through the through hole to protrude from the second cover. The lower case is hinged to the third cover and has an opening. The fixing element is pivoted to the lower case and has a locking portion. When the second cover is closed relative to the third cover, the lower case is located between the upper case and the third cover and the opening faces to a wall portion of the third cover. When the fixing element is pivotally rotated relative to the lower case, the locking portion passes through the opening to lock or unlock the wall portion of the third cover.

In an embodiment of the present invention, when the first cover departs from the boss, the fixing element is pivotally rotated due to the gravity to lock the third cover to make the boss protrude from the second cover.

In an embodiment of the present invention, the first cover is a scan lid.

In an embodiment of the present invention, the second cover is a scan base.

In an embodiment of the present invention, the third cover is a mid chassis.

The present invention is yet directed to a multifunction printer including a machine body, a first cover, a second cover, a third cover and a fixing element. The first cover and the second cover are hinged, the second cover and the third cover are hinged, and the third cover is hinged on the machine body. The second cover is installed between the first cover and the third cover. The fixing element is installed in the second cover to lock or unlock the third cover. When the first cover is opened relative to the second cover, the third cover is locked by the fixing element. When the first cover is closed relative to the second cover, the third cover is unlocked by the fixing element.

In an embodiment of the present invention, the second cover includes an upper case and a lower case. The lower case is hinged to the third cover and has an opening. The fixing element is pivoted to the lower case and has a locking portion. when the second cover is closed relative to the third cover, the lower case is located between the upper case and the third cover and the opening faces a wall portion of the third cover so as to make the locking portion pass through the opening to lock or unlock the wall portion of the third cover when the fixing element is pivotally rotated.

In an embodiment of the present invention, the multifunction printer further includes a first magnetic element and a second magnetic element. The first magnetic element is installed on the first cover, and the second magnetic element is installed on the fixing element. The first magnetic element and the second magnetic element are magnetically repelled to each other. When the second cover and the third cover are locked with each other by the fixing element and the first cover is closed relative to the second cover, the first magnetic element approaches the second magnetic element and the fixing element is driven to pivotally rotate by the magnetic repulsion force between the first magnetic element and the second magnetic element so as to enable the fixing element to unlock the third cover. When the first cover is opened relative to the second cover, the first magnetic element departs from the second magnetic element, and the fixing element is pivotally rotated due to the gravity so as to enable the fixing element to lock the third cover.

In an embodiment of the present invention, the multifunction printer further includes a first magnetic element and a second magnetic element. The first magnetic element is installed on the first cover, and the second magnetic element is installed on the fixing element. The first magnetic element and the second magnetic element are magnetically attracted to each other. When the second cover and the third cover are locked with each other by the fixing element and the first cover is closed relative to the second cover, the first magnetic element approaches the second magnetic element to and the fixing element is driven to pivotally rotate by the magnetic attraction force between the first magnetic element and the second magnetic element so as to enable the fixing element to unlock the third cover. When the first cover is opened relative to the second cover, the first magnetic element departs from the second magnetic element and the fixing element is pivotally rotated due to the gravity so as to enable the fixing element to lock the third cover.

In an embodiment of the present invention, the fixing element further has a boss protruding from the second cover and facing the first cover. When the first cover is closed relative to the second cover, the boss is pressed by the first cover to drive the fixing element to pivotally rotate so as to enable the fixing element to unlock the third cover. When the first cover is opened relative to the second cover, the first cover departs from the boss and the fixing element is pivotally rotated due to the gravity to lock the third cover so as to make the boss protrude from the second cover.

In an embodiment of the present invention, the first cover is a scan lid.

In an embodiment of the present invention, the second cover is a scan base.

In an embodiment of the present invention, the third cover is a mid chassis.

To sum up, in the embodiments of the present invention, the multifunction printer has the fixing element installed inside the second cover, and when the first cover is opened or closed relative to the second cover, the fixing element is capable of being pivotally rotated so as to lock or unlock the third cover. Accordingly, the multi-layer covers are locked or unlocked only by the elements as provided, without disposing additional fixing elements, which results in the reduction of the space configuration and the number of parts as required and contributes to the miniaturization and production cost down of the multifunction printer.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the present invention.

DESCRIPTION OF EMBODIMENTS

Figure 1:
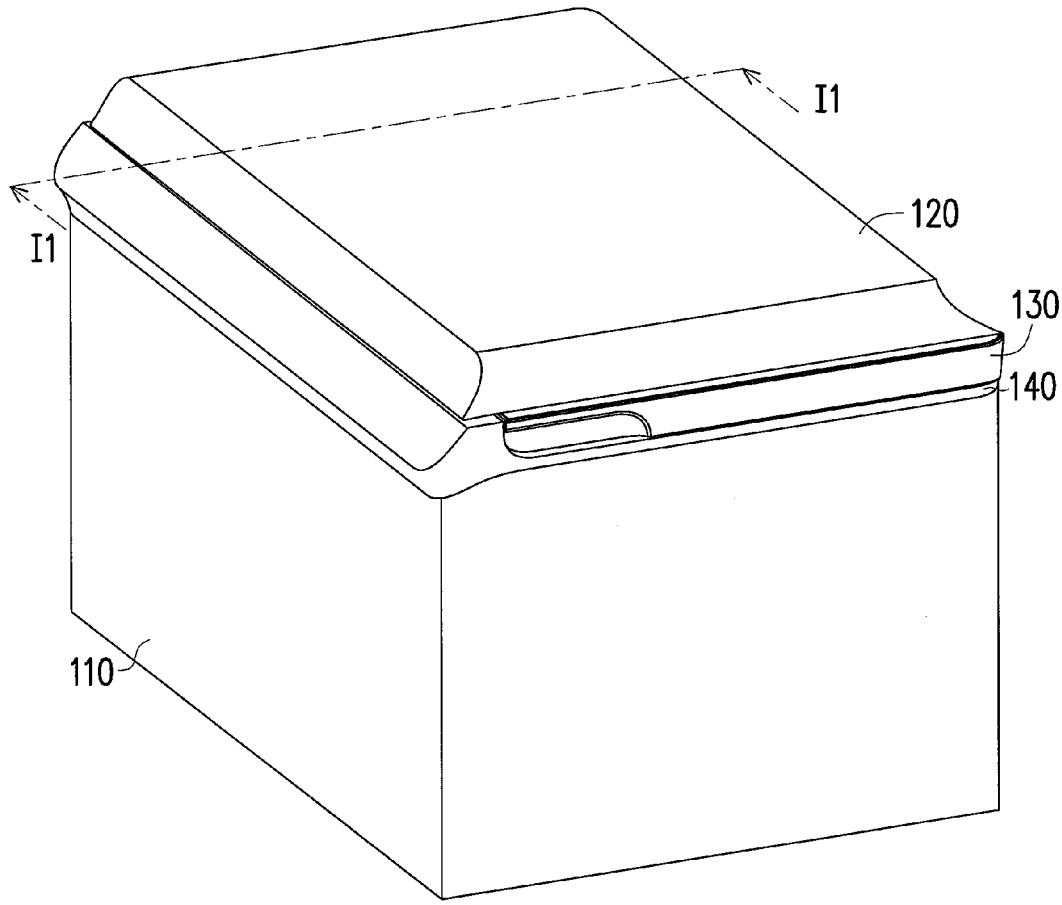
FIG. 1 is a schematic diagram illustrating a multifunction printer according to an embodiment of the present invention.
Figure 2:
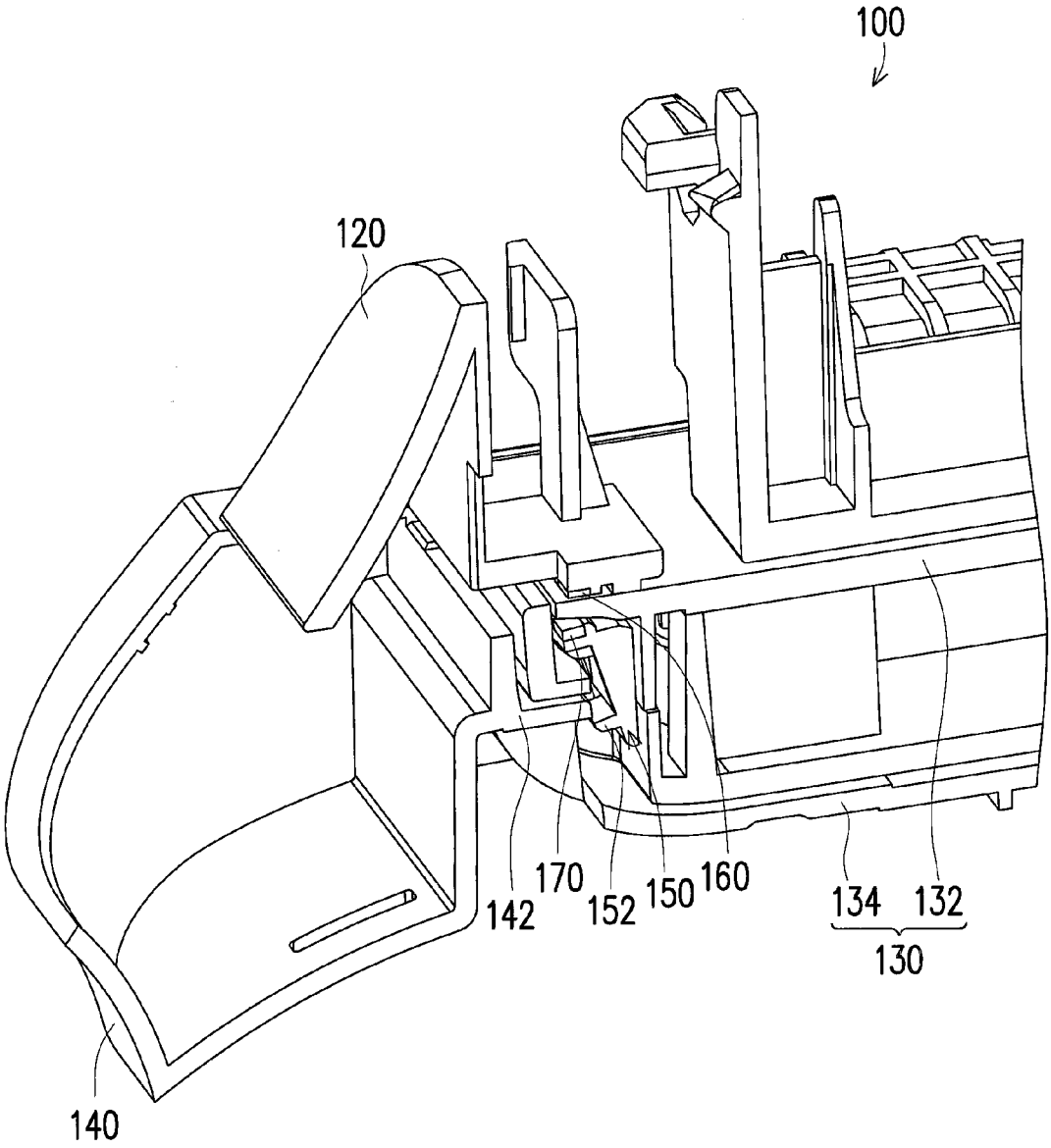
FIG. 2 is a cross-sectional diagram illustrating a part of the multifunction printer along a line I1-I1 in FIG. 1.

FIG. 1 is a schematic diagram illustrating a multifunction printer according to an embodiment of the present invention. FIG. 2 is a cross-sectional diagram illustrating a part of the multifunction printer along a line I1-I1 in FIG. 1. Referring to FIG. 1 and FIG. 2, in the present embodiment, a multifunction printer 100 includes a machine body 110, a first cover 120, a second cover 130, a third cover 140 and a fixing element 150. The first cover 120 and the second cover 130 are hinged, the second cover 130 and the third cover 140 are hinged, and the third cover 140 is hinged on the machine body 110, wherein the second cover 130 is installed between the first cover 120 and the third cover 140. It is to be mentioned that in order to be concise, the machine body 110 is not illustrated in FIG. 2.

For instance, the first cover 120 is a scan lid, the second cover 130 is a scan base, and the third cover 140 is a mid chassis in the present embodiment. If a scanning operation is to be performed by the multifunction printer 100, a user may open the first cover 120 relative to the second cover 130 and place the document to be scanned on the second cover 130. If an element inside the machine body 110 of the multifunction printer 100 is required to repair or replace, the user may open the third cover 140 relative to the machine body 110 for a maintenance operation.

Figure 3:
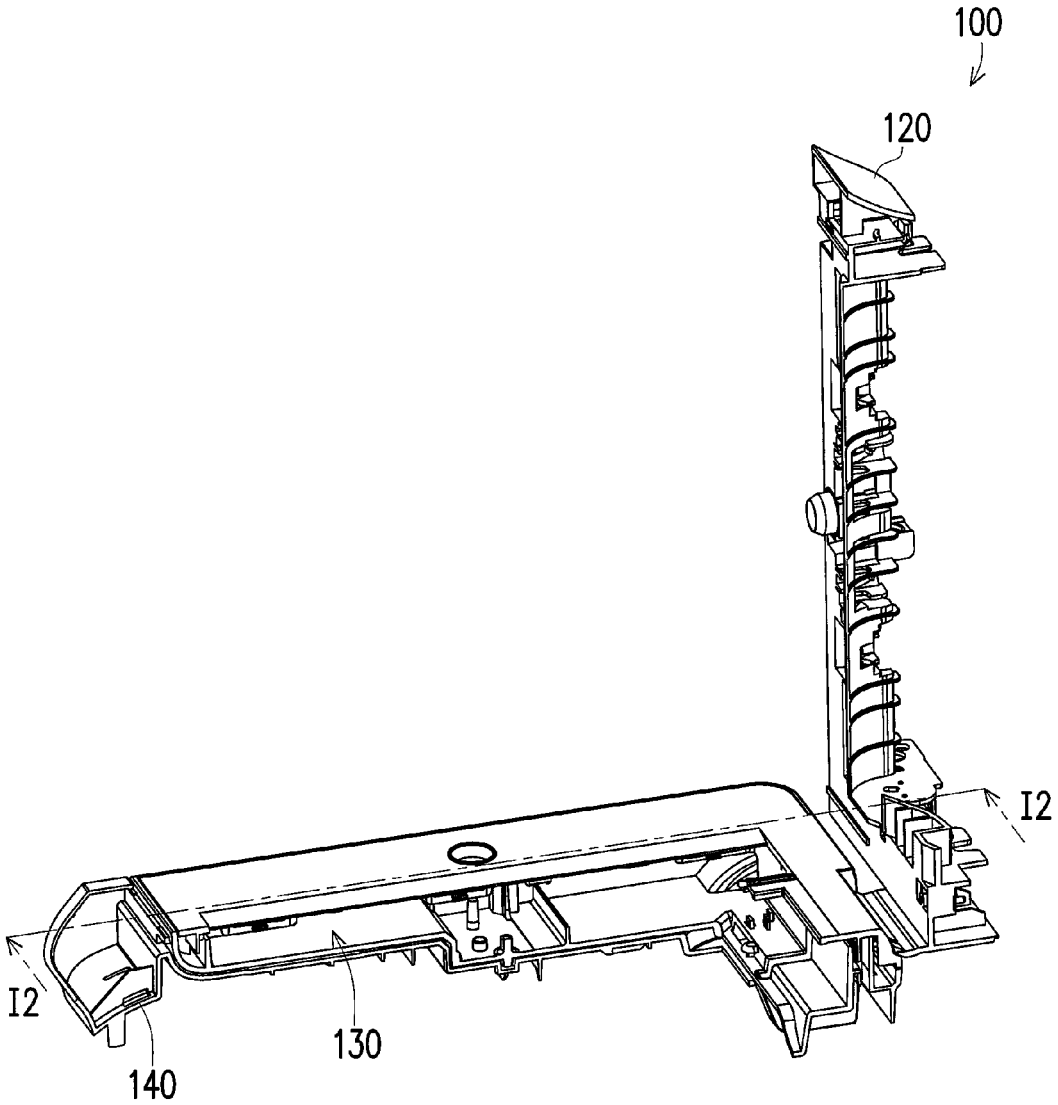
FIG. 3 is a cross-sectional three-dimensional diagram partially illustrating the first cover being opened relative to the second cover in FIG. 1.
Figure 4:
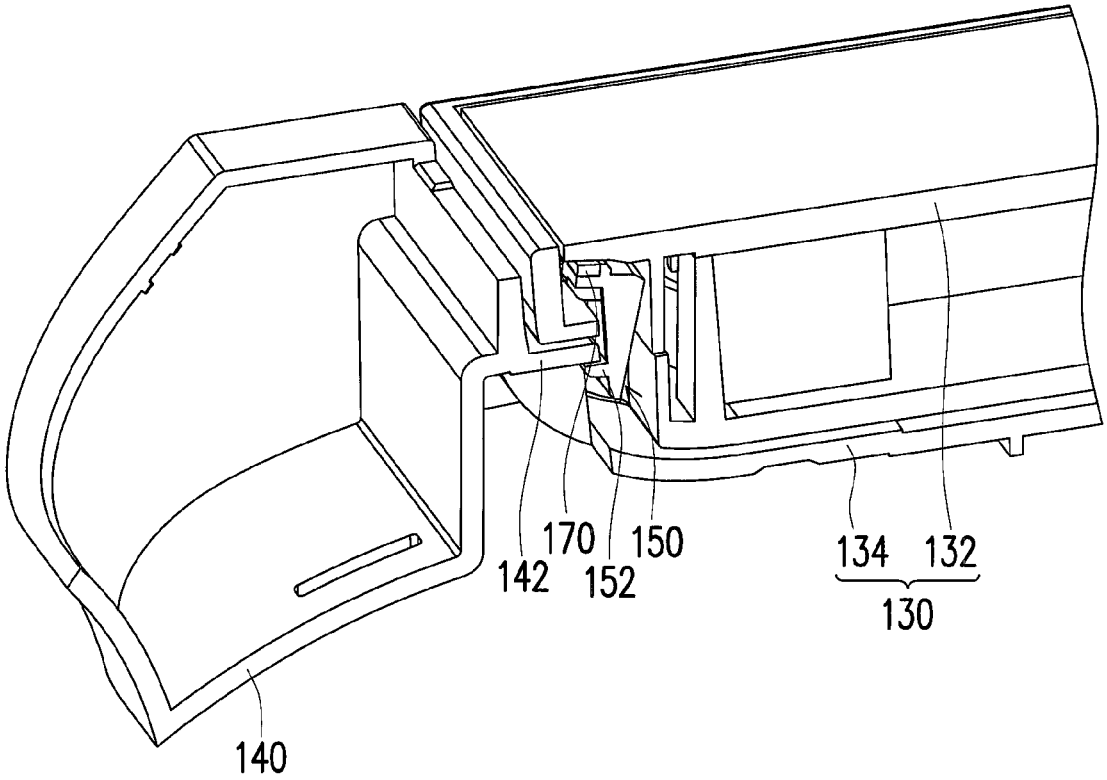
FIG. 4 a cross-sectional three-dimensional diagram partially illustrating the second cover and the third cover along a line I2-I2 in FIG. 3.

FIG. 3 is a cross-sectional three-dimensional diagram partially illustrating the first cover being opened relative to the second cover in FIG. 1. FIG. 4 a cross-sectional three-dimensional diagram partially illustrating the second cover and the third cover along a line I2-I2 in FIG. 3. Referring to FIG. 3 and FIG. 4 with FIG. 2, as described in the above, the fixing element 150 is installed in the second cover 130 and capable of being pivotally rotated inside the second cover 130 so as to lock or unlock the third cover 140. When the first cover 120 is opened relative to the second cover 130, the second cover 130 and the third cover 140 are locked with each other by the fixing element 150 (as shown in FIG. 4). When the first cover 120 is closed relative to the second cover 130, the third cover 140 is unlocked by the fixing element 150 (as shown in FIG. 2). Thus, multi-layer covers are locked or unlocked by the installation of the pivotally rotatable fixing element 150 in the multifunction printer 100, and the installation of additional fixing elements is not necessary. Accordingly, space configuration required by the multifunction printer 100 may be reduced, which contributes to the product miniaturization of the multifunction printer 100. Besides, the number of parts is reduced and thus, the parts required by the multifunction printer 100 are also reduced, such that the production cost of the multifunction printer 100 may be lowered down.

Figure 5:
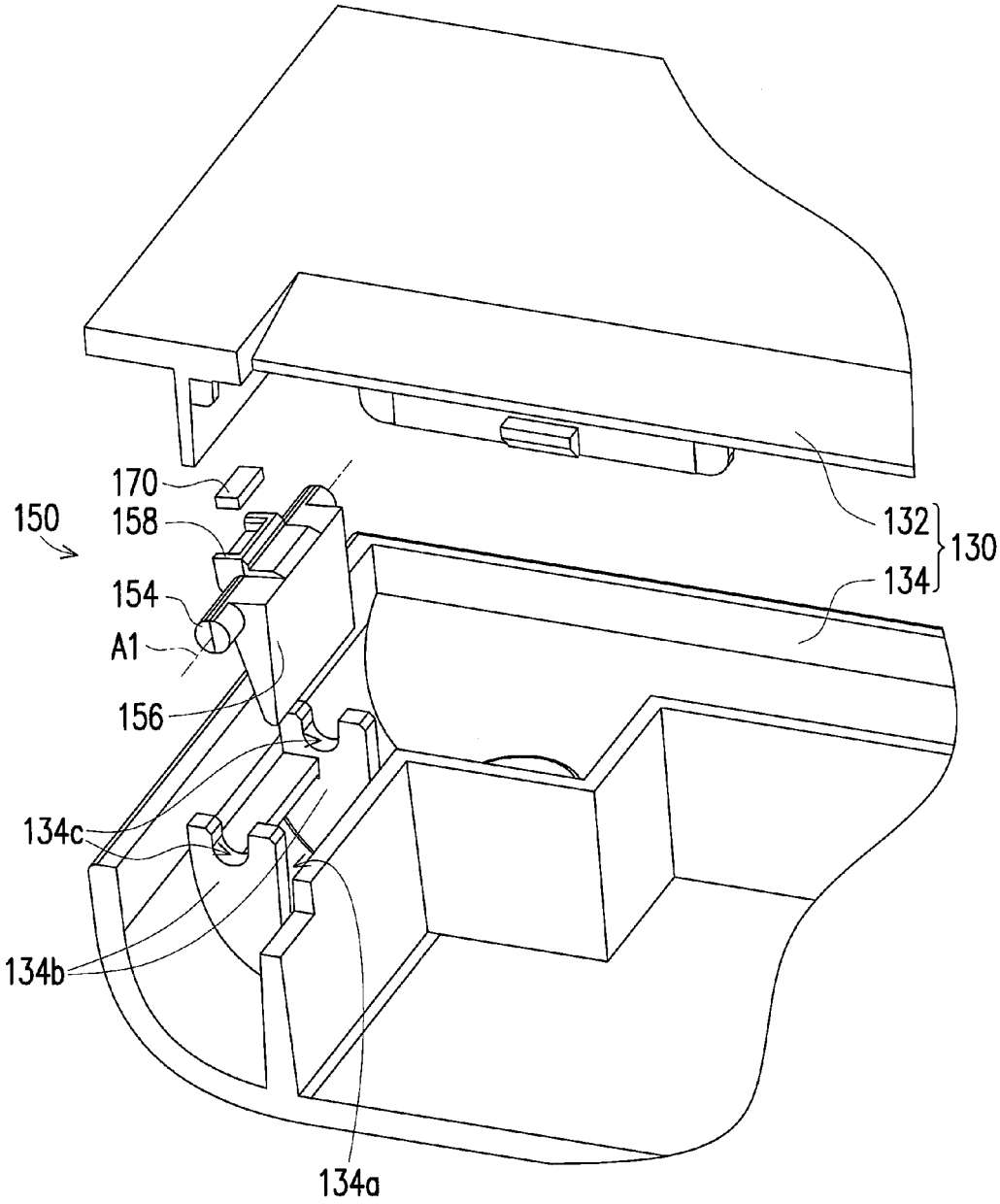
FIG. 5 is an exploded diagram partially illustrating the second cover and the fixing element in FIG. 4.

FIG. 5 is an exploded diagram partially illustrating the second cover and the fixing element in FIG. 4. Referring to FIG. 5 with FIG. 2 and FIG. 4, the second cover 130 of the present embodiment includes an upper case 132 and a lower case 134, wherein internal elements of the second cover 130 (e.g. a scan glass) are omitted in FIG. 5. The lower case 134 is hinged to the third cover 140 and has an opening 134*a*. The fixing element 150 is pivoted to the lower case 134 and has a locking portion 152. When the second cover 130 is closed relative to the third cover 140, the lower case 134 is located between the upper case 132 and the third cover 140. The opening 134*a* of the lower case 134 faces a wall portion 142 of the third cover 140, such that when the fixing element 150 is pivotally rotated, the locking portion 152 passes through the opening 134*a* of the lower case 134 to lock or unlock the wall portion 142 of the third cover 140.

Figure 6:
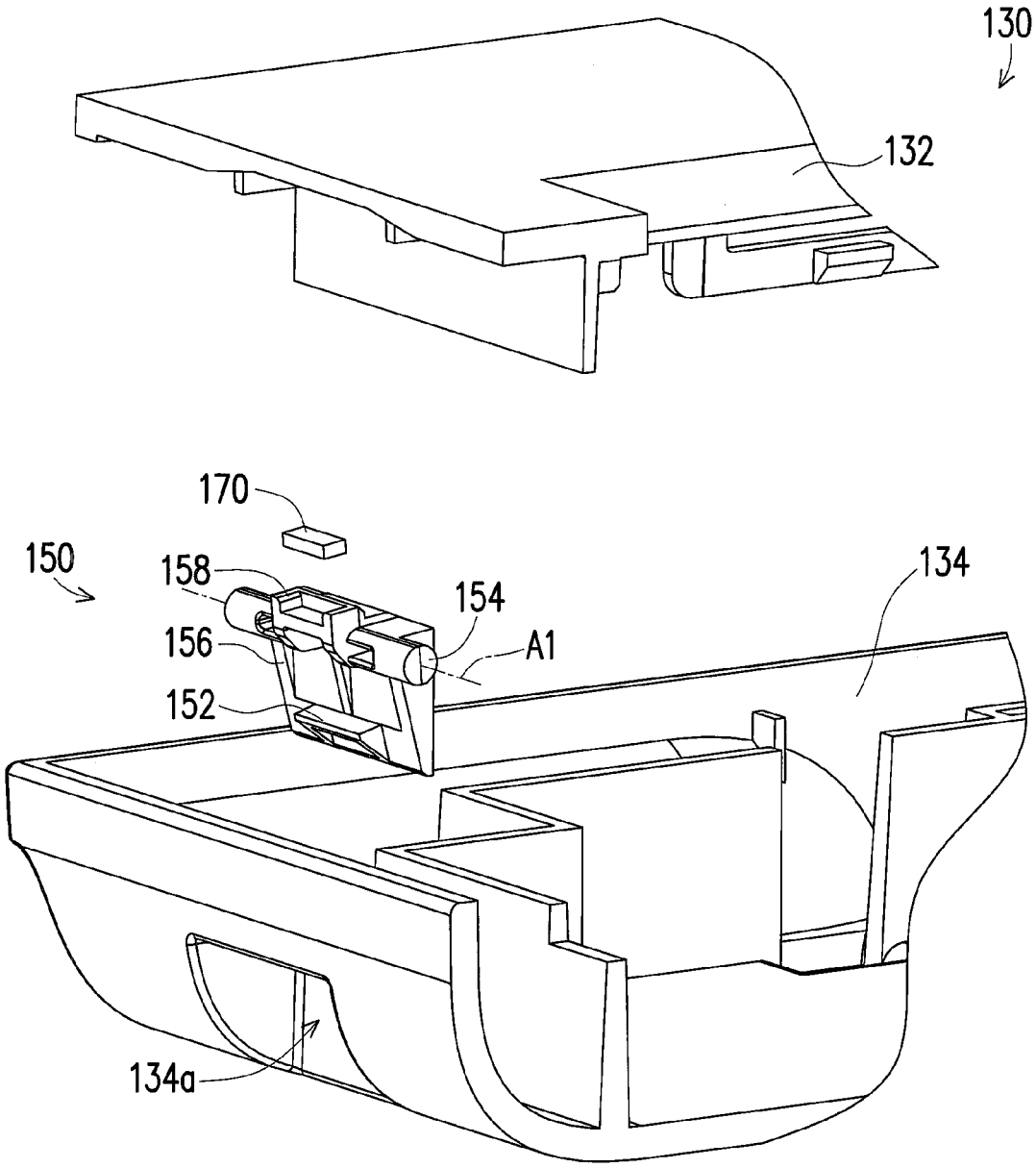
FIG. 6 is an exploded diagram partially illustrating the second cover and the fixing element in FIG. 5 from another viewing angle.

FIG. 6 is an exploded diagram partially illustrating the second cover and the fixing element in FIG. 5 from another viewing angle. Referring to FIG. 6 with FIG. 5, in detail, the fixing element 150 further has a pivot 154, a first arm 156 and a second arm 158. The first arm 156 and the second arm 158 are located at two opposite ends of the pivot 154 and are rotated with the pivot 154 as a center. The locking portion 152 is installed on the first arm 156. The lower case 134 further has a pair of pivoting portions 134*b*. Each of the pivoting portions 134*b* has a recess 134*c*, and each recess 134*c* has a shape that is adaptive to the opposite ends of the pivot 154. Thus, after the fixing element 150 is installed in the second cover 130, the fixing element 150 may be guided to smoothly rotate with the two ends of the pivot 154 and the recesses 134*c* corresponding thereto when the fixing element 150 is rotated with a center axis A1 of the pivot 154 as a rotation axis.

In the present invention, the fixing element 150 is pivoted to the second cover 130 and the locking portion 152 of the fixing element 150 is pivotally rotated to different positions for locking or unlocking the wall portion 142 of the third cover 140, and thereby, the second cover 130 and the third cover 140 are locked together or unlocked from each other. Accordingly, the following embodiments are illustrated as examples of how the fixing element 150 is driven to be pivotally rotated.

First Embodiment

Figure 7A:
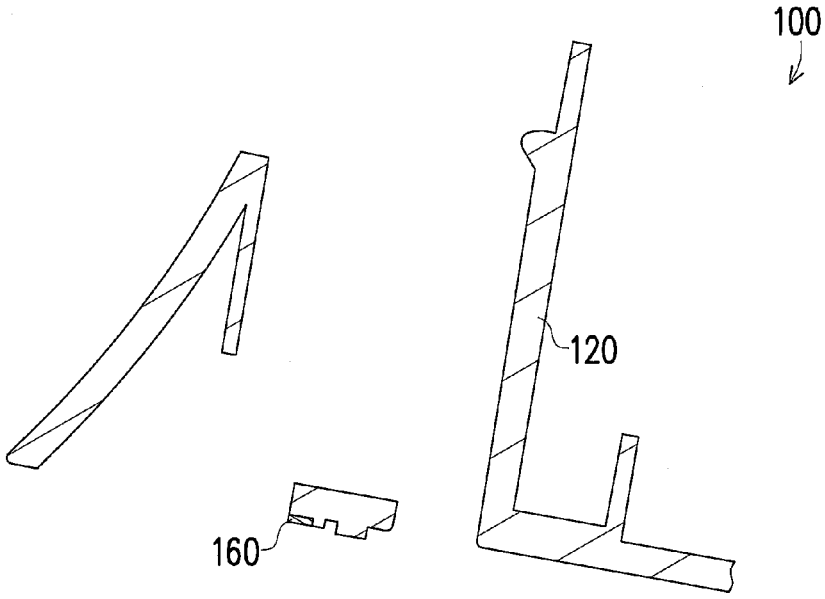
FIG. 7A through FIG. 7C are schematic diagrams illustrating a process of locking and unlocking the second cover and the third cover of the multifunction printer according to a first embodiment of the present invention.
Figure 7A:
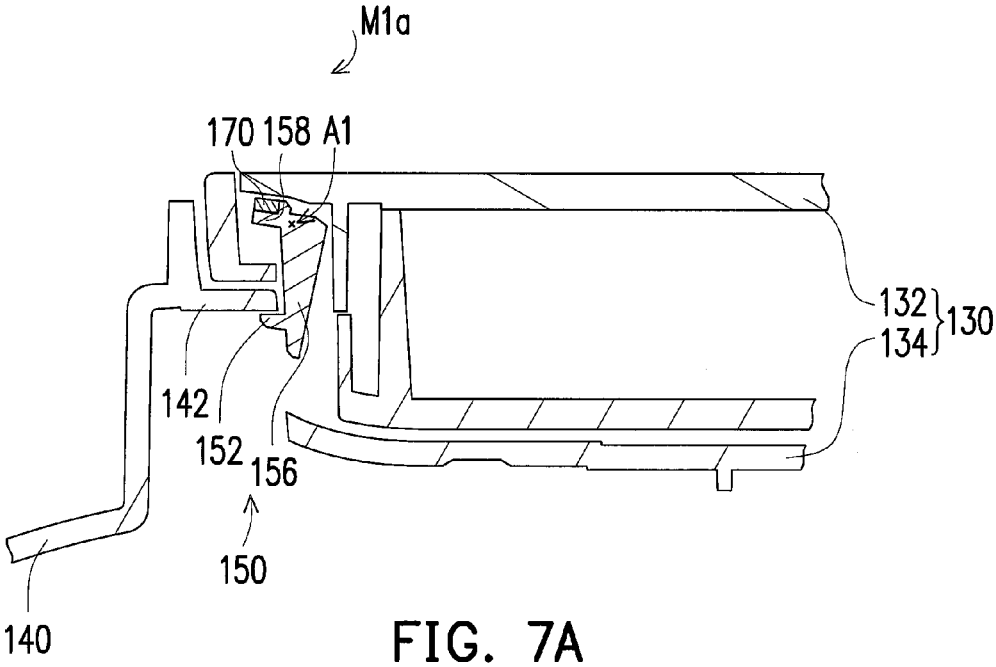
Figure 7B:
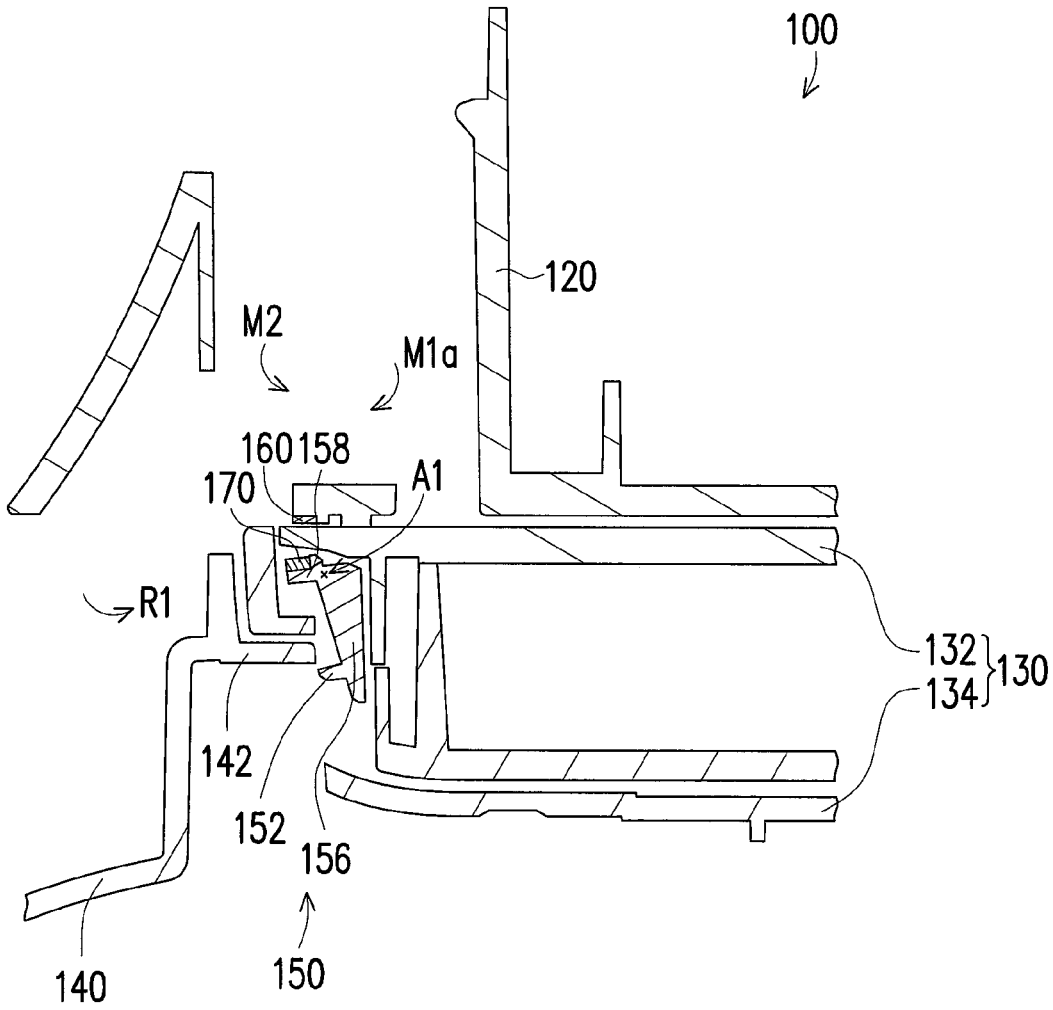
Figure 7C:
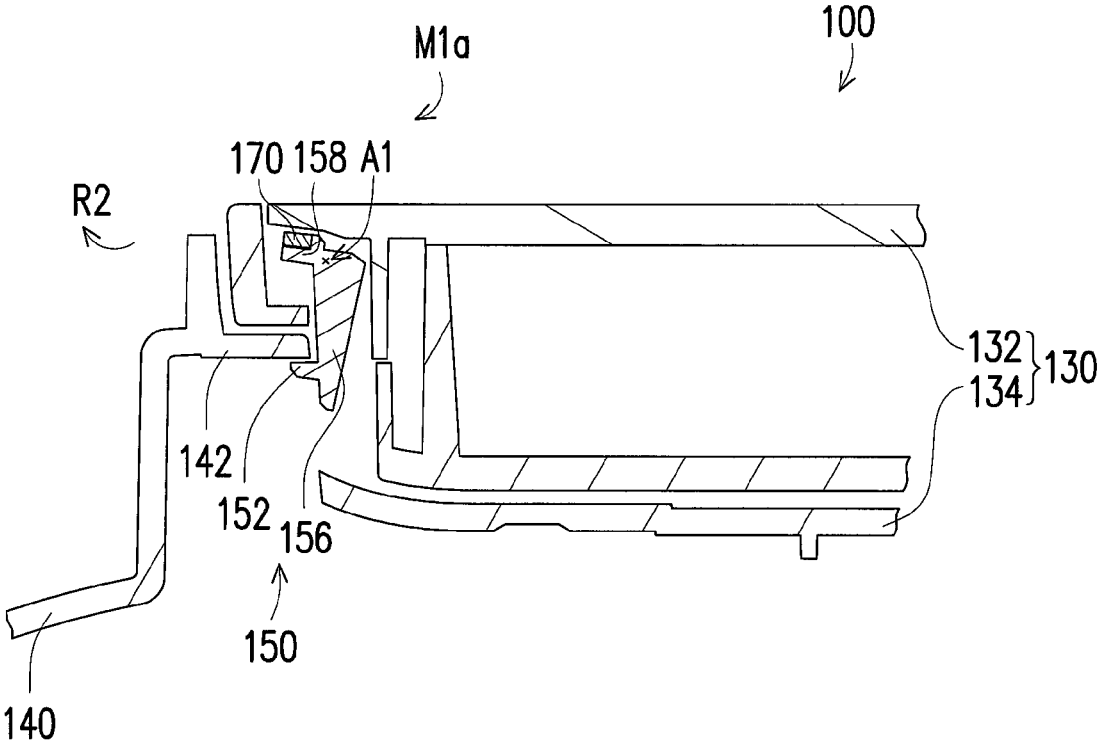

FIG. 7A through FIG. 7C are schematic diagrams illustrating a process of locking and unlocking the second cover and the third cover of the multifunction printer according to a first embodiment of the present invention. Referring to FIG. 7A through FIG. 7C with FIG. 2 and FIG. 4, the multifunction printer 100 of the present embodiment further includes a first magnetic element 160 and a second magnetic element 170. The first magnetic element 160 is installed on the first cover 120, and the second magnetic element 170 is installed on the fixing element 150. The first magnetic element 160 and the second magnetic element 170 are magnetically repelled to each other.

Furthermore, the second magnetic element 170 is installed on the second arm 158 of the fixing element 150 and a weight sum of the first arm 156 and the locking portion 152 is greater than a weight sum of the second arm 158 and the second magnetic element 170. Thus, in a state where no external force is received, the fixing element 150 is adaptive to generate a first moment M1*a* with the center axis A1 as a rotation axis, such that the locking portion 152 passes through the opening 134*a* of the lower case 134 to lock the wall portion 142 of the third cover 140.

Then, when the first cover 120 is closed relative to the second cover 130 to make the first magnetic element 160 approach the upper place of the second magnetic element 170, a second moment M2 is generated by the magnetic repulsion force between the first magnetic element 160 and the second magnetic element 170 with the center axis A1 as the rotation axis. The second moment M2 is greater than the first moment M1*a* and thus, the fixing element 150 is rotated along a first rotation direction R1 with the center axis A1 as the rotation axis, such that the wall portion 142 of the third cover 140 is unlocked by the locking portion 152 of the fixing element 150 (as shown in FIG. 7B), wherein the first rotation direction R1 is counterclockwise direction shown in the FIG. 7B.

However, when the second cover 130 is closed relative to the third cover 140 and the first cover 120 is opened relative to the second cover 130, the first magnetic element 160 departs from the second magnetic element 170, such that the second moment M2 decreasingly becomes small. Once the first moment M1*a* is greater than the second moment M2, the fixing element 150 is again rotated along second rotation direction R2 with the center axis A1 as the rotation axis, such that the wall portion 142 of the third cover 140 is again locked by the locking portion 152 of the fixing element 150 (as shown in FIG. 7C), wherein the second rotation direction R2 is a clockwise direction shown in FIG. 7C.

By such manner, the fixing element 150 may be pivotally rotated inside the second cover 130 by the first moment M1*a* generated by the weight of the fixing element 150 itself and the magnetic repulsion force between the two magnetic elements 160 and 170, such that the wall portion 142 is locked or unlocked by the locking portion 152, i.e. the second cover 130 and the third cover 140 are locked together or unlocked from each other.

Second Embodiment

Figure 8A:
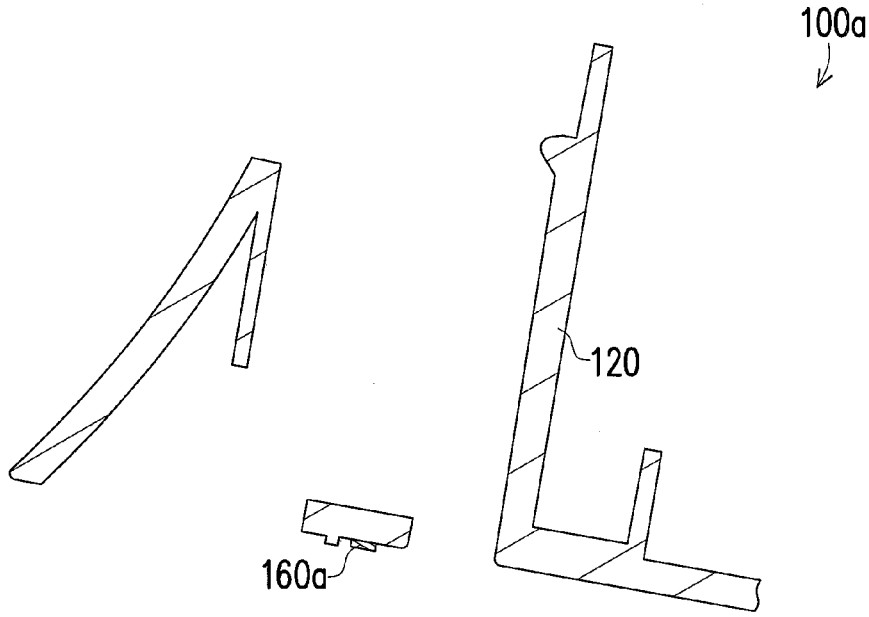
FIG. 8A through FIG. 8C are schematic diagrams illustrating a process of locking and unlocking the second cover and the third cover of the multifunction printer according to a second embodiment of the present invention.
Figure 8A:
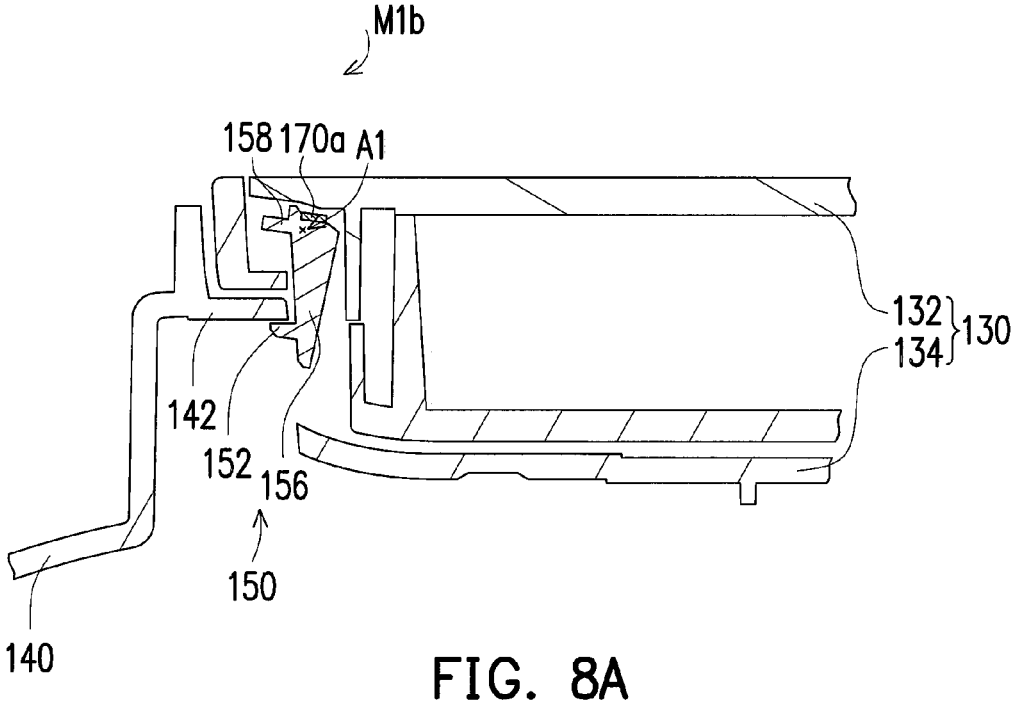
Figure 8B:
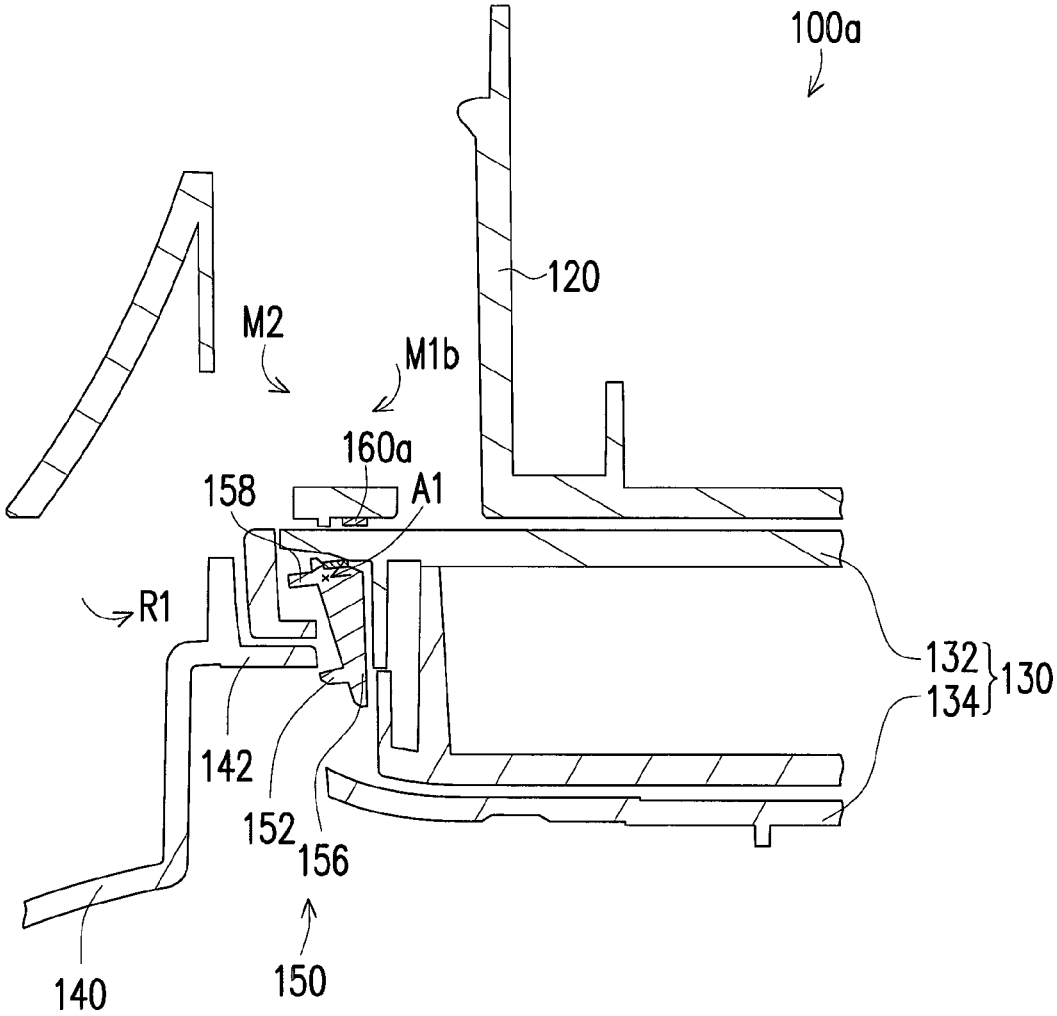
Figure 8C:
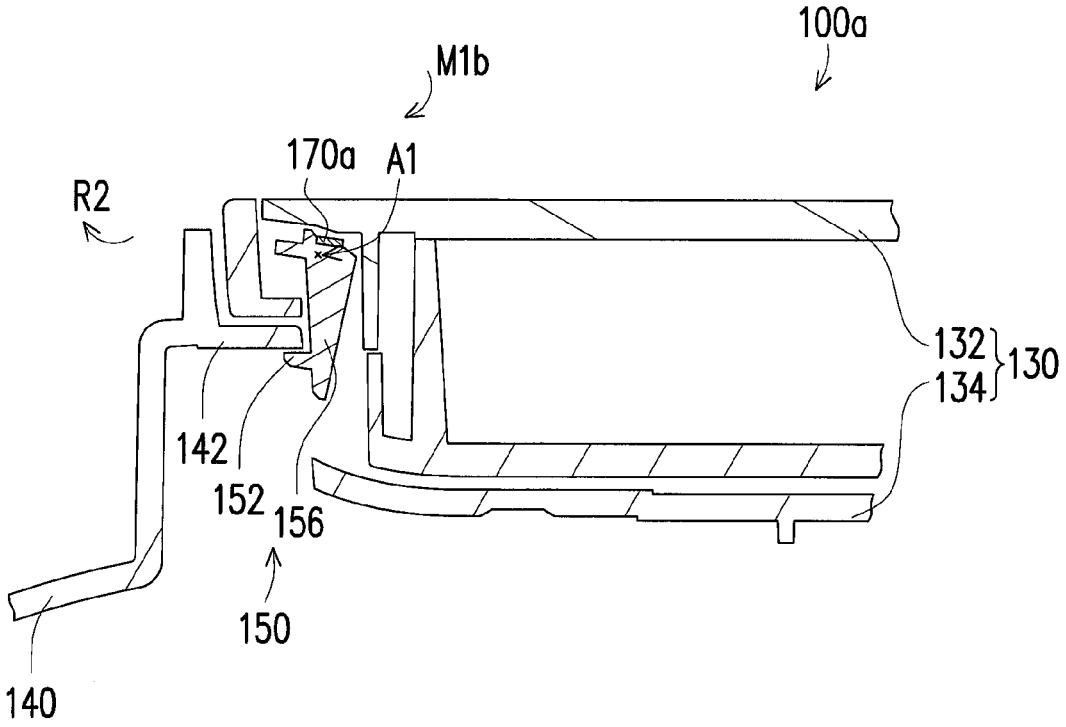

FIG. 8A through FIG. 8C are schematic diagrams illustrating a process of locking and unlocking the second cover and the third cover of the multifunction printer according to a second embodiment of the present invention. A multifunction printer 100*a* of the present embodiment is similar to the multifunction printer 100 illustrated in FIG. 7A through FIG. 7C, and thus, only the difference therebetween is introduced herein, wherein the same or similar symbols represent the same or similar elements and will not be repeated herein. Referring to FIG. 8A through FIG. 8C, the first magnetic element 160*a* and the second magnetic element 170*a* of the present embodiment are magnetically attracted to each other.

Furthermore, the second magnetic element 170*a* is installed on the first arm 156 of the fixing element 150, and a weight sum of the first arm 156, the locking portion 152 and the second magnetic element 170*a* is greater than a weight of the second arm 158. Thus, when the first cover 120 departs from the second cover 130, i.e. in a state where no external force is received by the fixing element 150, a first moment M1*b* is generated by the first arm 156, the locking portion 152 and the second magnetic element 170*a*, such that the locking portion 152 is clockwise rotated to lock the wall portion 142 of the third cover 140.

Then, when the first cover 120 is closed relative to the second cover 130 to make the first magnetic element 160*a* approach the upper place of the second magnetic element 170*a*, the second moment M2 is generated by the magnetic attraction force between the first magnetic element 160*a* and the second magnetic element 170*a*. The second moment M2 is greater than the first moment M1*b* and thus, the fixing element 150 is driven and rotated along a first rotation direction R1 such that the wall portion 142 of the third cover 140 is unlocked by the locking portion 152 (as shown in FIG. 8B).

Then, when the second cover 130 is maintained closed relative to the third cover 140 and the first cover 120 is opened relative to the second cover 130, the first magnetic element 160*a* departs from the second magnetic element 170*a*, such that the second moment M2 decreasingly becomes small. Once the first moment M1*b* is greater than the second moment M2, the fixing element 150 may be again driven by the first moment M1*b* to rotate along the second rotation direction R2, such that the wall portion 142 of the third cover 140 is locked again by the locking portion 152 of the fixing element 150 (as shown in FIG. 8C).

By such manner, the fixing element 150 may be pivotally rotated inside the second cover 130 by the first moment M1*b* generated by the weight of the fixing element 150 itself, the second moment M2 generated by the magnetic attraction force between the two magnetic elements 160*a*, 170*a*, and the change of positions of the magnetic elements 160*a*, 170*a*, such that the wall portion 142 is locked or unlocked by the locking portion 152 and the second cover 130 and the third cover 140 are locked together or unlock from each other.

Third Embodiment

Figure 9A:
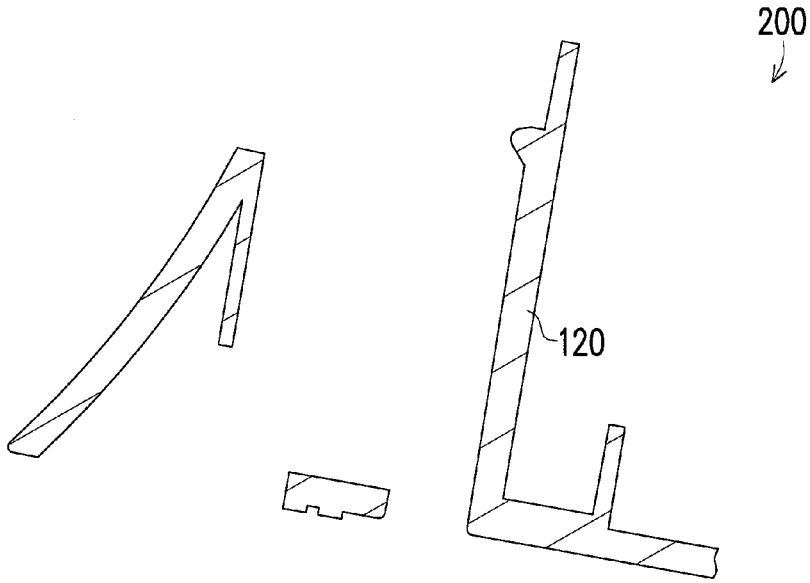
FIG. 9A through FIG. 9C are schematic diagrams illustrating a process of locking and unlocking the second cover and the third cover of the multifunction printer according to a third embodiment of the present invention.
Figure 9A:
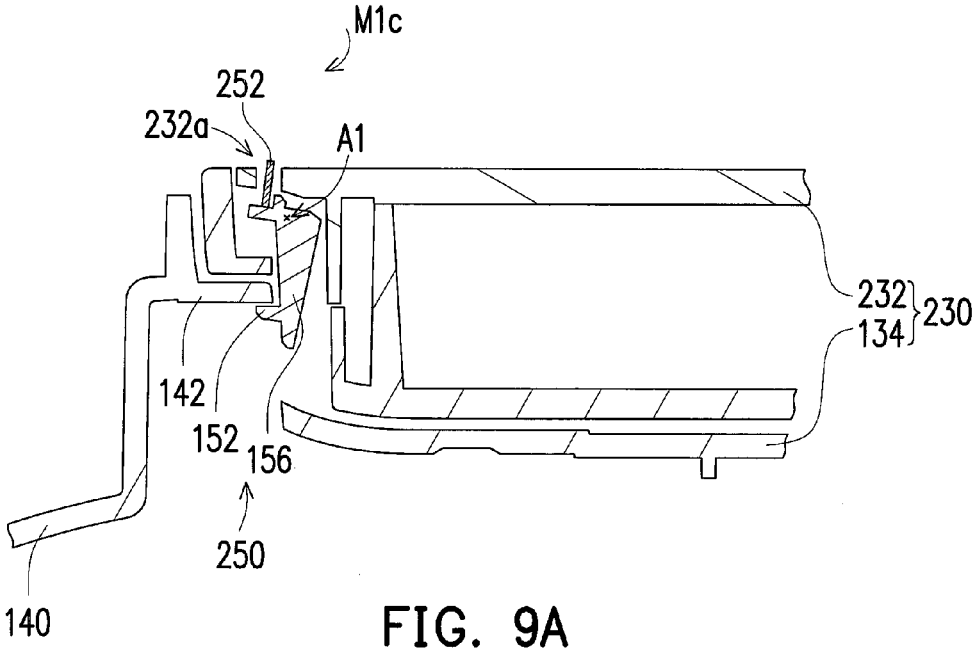
Figure 9B:
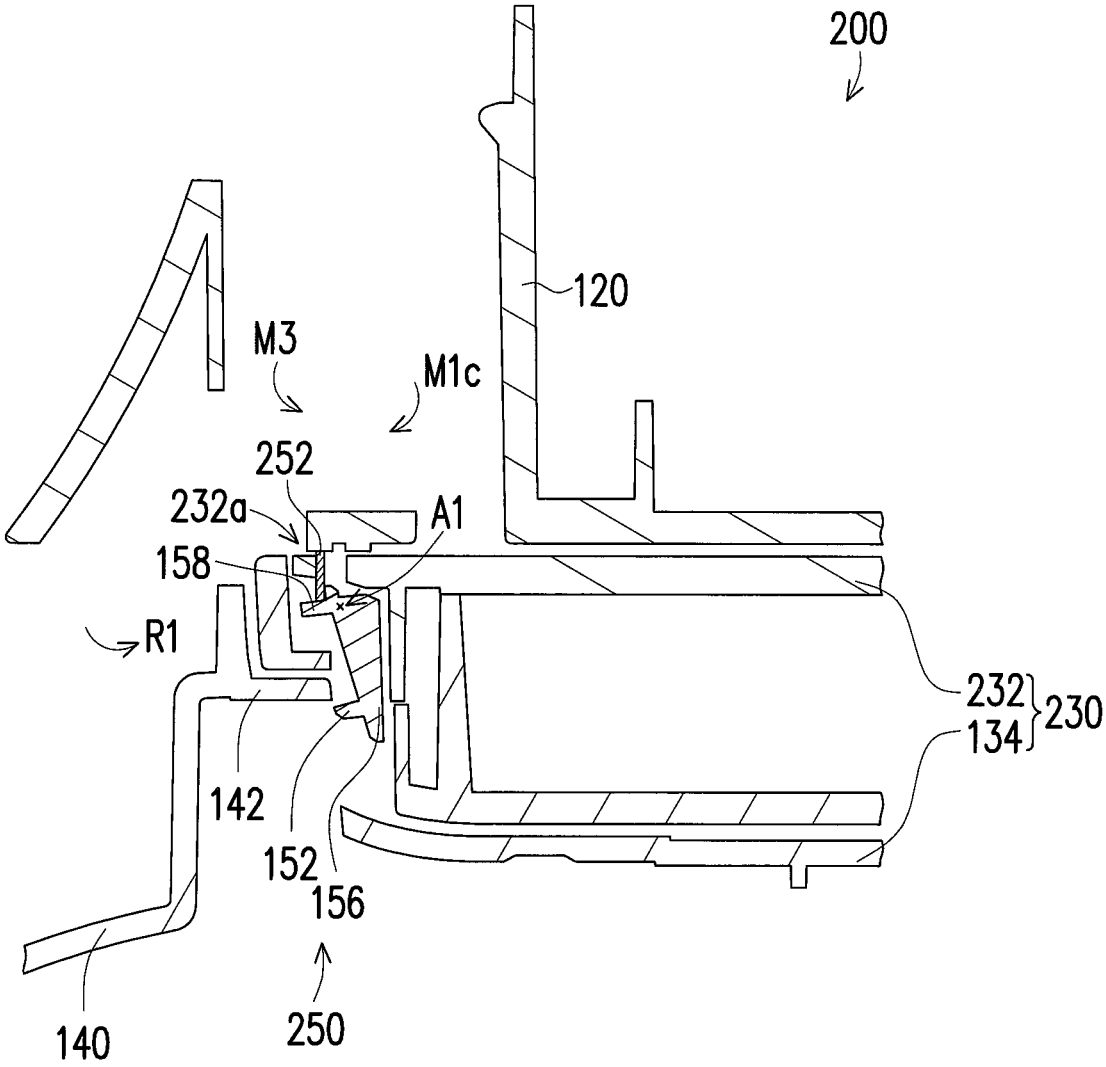
Figure 9C:
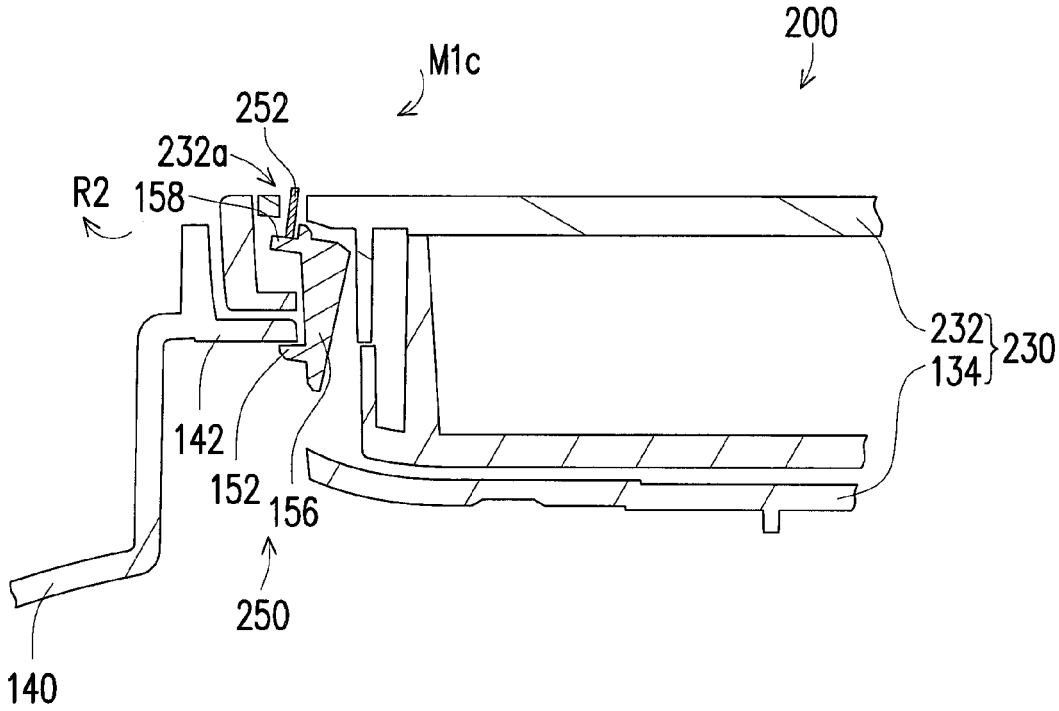

FIG. 9A through FIG. 9C are schematic diagrams illustrating a process of locking and unlocking the second cover and the third cover of the multifunction printer according to a third embodiment of the present invention. A multifunction printer 200 of the present embodiment is similar to the multifunction printer 100 illustrated in FIG. 7A through FIG. 7C, and thus, only the difference therebetween is introduced herein, wherein the same or similar symbols represent the same or similar elements and will not be repeated herein. Referring to FIG. 9A through FIG. 9C, in the present embodiment, a fixing element 250 has a boss 252, an upper case 232 of a second cover 230 has a through hole 232*a*, and the boss 252 is capable of passing through the through hole 232*a*.

Moreover, the boss 252 is located on the second arm 158, and a weight sum of the first arm 156 and the locking portion 152 is greater than a weight sum of the second arm 158 and the boss 252. Thus, when no external force is received by the fixing element 250, a first moment M1*c* is generated by the first arm 156 and the locking portion 152 due to the gravity, such that the second cover 230 and the third cover 140 are locked together by the fixing element 250.

Then, when the first cover 120 is closed relative to the second cover 230 and covers the through hole 232*a* of the upper case 232, the first cover 120 leans against the boss 252 of the fixing element 250 and thus, a third moment M3 is generated to drive the fixing element 250 to rotate along the first rotation direction R1, such that the wall portion 142 of the third cover 140 is unlocked by the locking portion 152 of the fixing element 250 (as shown in FIG. 9B).

Then, when the second cover 230 is maintained closed relative to the third cover 140, but the first cover 120 is opened relative to the second cover 230, the first cover 120 departs from the through hole 232*a* of the upper case 232, and thus, the aforementioned third moment M3 is disappeared. Accordingly, the fixing element 250 is rotated along the second rotation direction R2 by the first moment M1, such that the wall portion 142 of the third cover 140 is again locked by the locking portion 152 of the fixing element 250 (as shown in FIG. 9C).

By such manner, the fixing element 250 may be pivotally rotated inside the second cover 130 and the wall portion 142 is locked or unlocked by the locking portion 152 by the first moment M1*c* generated by the weight of the fixing element 150 itself and the third moment M3 generated by the first cover 120 pushing boss 252 of the fixing element 250, such that the second cover 130 and the third cover 140 are locked together or unlock from each other.

Based on the above, the multifunction printer of the present invention has the fixing element installed inside the second cover, and the fixing element is capable of pivotally rotating inside the second cover, such that the second cover and the third cover are locked together or unlocked from each other by the fixing element. Accordingly, the multi-layer covers are locked or unlocked by only one fixing element, which results in the reduction of the space configuration of the multifunction printer and contributes to the production miniaturization of the multifunction printer. Additionally, since the number of elements is reduced, the parts used by the multifunction printer can be reduced and the production cost of the multifunction printer can be lowered down. Meanwhile, when the multifunction printer includes two magnetic elements that are magnetically repelled or attracted to each other, the fixing element can be driven to pivotally rotate by the moment generated by the magnetic force. Further, when the fixing element has the boss and the upper case has the cooperative through hole, the fixing element can be driven by the moment generated by the first cover pushing the boss due to the gravity.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A multifunction printer, comprising:

a machine body;

a first cover, a second cover and a third cover, wherein the first cover and the second cover are hinged, the second cover and the third cover are hinged, the third cover is hinged on the machine body, and the second cover is installed between the first cover and the third cover; and a fixing element, installed in the second cover and pivotally rotated in the second cover, wherein the second cover comprises an upper case and a lower case, the lower case is hinged to the third cover and has an opening, the fixing element is pivoted to the lower case and has a locking portion;

a first magnetic element, installed on the first cover; and a second magnetic element, installed on the fixing element, wherein when the second cover is closed relative to the third cover and the first cover is opened relative to the second cover to make the first magnetic element and the second magnetic element depart from each other, the third cover is locked by the fixing element, and when the first cover is closed relative to the second cover to make the first magnetic element and the second magnetic element approach to each other, the third cover is unlocked by the fixing element, when the second cover is closed relative to the third cover, the lower case is located between the upper case and the third cover and the opening faces a wall portion of the third cover, and when the fixing element is pivotally rotated relative to the lower case, the locking portion passes through the opening to lock or unlock the wall portion of the third cover.

2. The multifunction printer according to claim 1, wherein the first magnetic element and the second magnetic element are magnetically repelled to each other, when the third cover is locked by the fixing element and the first cover is closed relative to the second cover, the first magnetic element approaches the second magnetic element and the fixing element is driven to pivotally rotate by the magnetic repulsion force between the first magnetic element and the second magnetic element so as to enable the fixing element to unlock the third cover, and when the second cover is closed relative to the third cover and the first cover is opened relative to the second cover, the first magnetic element departs from the second magnetic element, and the fixing element is pivotally rotated due to the gravity so as to enable the fixing element to lock the third cover.

3. The multifunction printer according to claim 1, wherein the first magnetic element and the second magnetic element are magnetically attracted to each other, when the second cover and the third cover are locked with each other by the fixing element and the first cover is closed relative to the second cover, the first magnetic element approaches the second magnetic element and the fixing element is driven to pivotally rotate by the magnetic attraction force between the first magnetic element and the second magnetic element so as to enable the fixing element to unlock the third cover, and when the second cover is closed relative to the third cover and the first cover is opened relative to the second cover, the first magnetic element departs from the second magnetic element and the fixing element is pivotally rotated due to the gravity so as to enable the fixing element to lock the third cover.

4. The multifunction printer according to claim 1, wherein the first cover is a scan lid.

5. The multifunction printer according to claim 1, wherein the second cover is a scan base.

6. The multifunction printer according to claim 1, wherein the third cover is a mid chassis.

7. A multifunction printer, comprising:

a machine body;

a first cover, a second cover and a third cover, wherein the first cover and the second cover are hinged, the second cover and the third cover are hinged, the third cover is hinged on the machine body, and the second cover is installed between the first cover and the third cover; and a fixing element, pivoted to the second cover and having a boss protruding from the second cover and facing the first cover, wherein the second cover comprises an upper case and a lower case, the upper case has a through hole, the boss passes through the through hole to protrude from the second cover, the lower case is hinged to the third cover and has an opening, the fixing element is pivoted to the lower case and has a locking portion, when the second cover is closed relative to the third cover and the first cover is opened relative to the second cover to make the first cover depart from the boss, the third cover is locked by the fixing element, when the first cover is closed relative to the second cover, the boss is pressed by the first cover to drive the fixing element to pivotally rotate so as to enable the fixing element to unlock the third cover, when the second cover is closed relative to the third cover, the lower case is located between the upper case and the third cover and the opening faces to a wall portion of the third cover, and when the fixing element is pivotally rotated relative to the lower case, the locking portion passes through the opening to lock or unlock the wall portion of the third cover.

8. The multifunction printer according to claim 7, wherein when the first cover departs from the boss, the fixing element is pivotally rotated due to the gravity to lock the third cover to make the boss protrude from the second cover.

9. The multifunction printer according to claim 7, wherein the first cover is a scan lid.

10. The multifunction printer according to claim 7, wherein the second cover is a scan base.

11. The multifunction printer according to claim 7, wherein the third cover is a mid chassis.

12. A multifunction printer, comprising:

a machine body;

a first cover, a second cover and a third cover, wherein the first cover and the second cover are hinged, the second cover and the third cover are hinged, the third cover is hinged on the machine body, and the second cover is installed between the first cover and the third cover; and a fixing element, installed in the second cover to lock or unlock the third cover, wherein the second cover comprises an upper case and a lower case, the lower case is hinged to the third cover and has an opening, the fixing element is pivoted to the lower case and has a locking portion, wherein when the first cover is opened relative to the second cover, the third cover is locked by the fixing element, and when the first cover is closed relative to the second cover, the third cover is unlocked by the fixing element, when the second cover is closed relative to the third cover, the lower case is located between the upper case and the third cover and the opening faces a wall portion of the third cover so as to make the locking portion pass through the opening to lock or unlock the wall portion of the third cover when the fixing element is pivotally rotated.

13. The multifunction printer according to claim 12, further comprising:

a first magnetic element;

and a second magnetic element, wherein the first magnetic element is installed on the first cover, and the second magnetic element is installed on the fixing element, the first magnetic element and the second magnetic element are magnetically repelled to each other, when the second cover and the third cover are locked with each other by the fixing element and the first cover is closed relative to the second cover, the first magnetic element approaches the second magnetic element and the fixing element is driven to pivotally rotate by the magnetic repulsion force between the first magnetic element and the second magnetic element so as to enable the fixing element to unlock the third cover, and when the first cover is opened relative to the second cover, the first magnetic element departs from the second magnetic element, and the fixing element is pivotally rotated due to the gravity so as to enable the fixing element to lock the third cover.

14. The multifunction printer according to claim 12, further comprising:

a first magnetic element;

and a second magnetic element, wherein the first magnetic element is installed on the first cover, and the second magnetic element is installed on the fixing element, the first magnetic element and the second magnetic element are magnetically attracted to each other, when the second cover and the third cover are locked with each other by the fixing element and the first cover is closed relative to the second cover, the first magnetic element approaches the second magnetic element and the fixing element is driven to pivotally rotate by the magnetic attraction force between the first magnetic element and the second magnetic element so as to enable the fixing element to unlock the third cover, and when the first cover is opened relative to the second cover, the first magnetic element departs from the second magnetic element and the fixing element is pivotally rotated due to the gravity so as to enable the fixing element to lock the third cover.

15. The multifunction printer according to claim 12, wherein the fixing element further has a boss protruding from the second cover and facing the first cover, when the first cover is closed relative to the second cover, the boss is pressed by the first cover to drive the fixing element to pivotally rotate so as to enable the fixing element to unlock the third cover, and when the first cover is opened relative to the second cover, the first cover departs from the boss and the fixing element is pivotally rotated due to the gravity to lock the third cover so as to make the boss protrude from the second cover.

16. The multifunction printer according to claim 12, wherein the first cover is a scan lid.

17. The multifunction printer according to claim 12, wherein the second cover is a scan base.

18. The multifunction printer according to claim 12, wherein the third cover is a mid chassis.

* * * * *